US010358307B1

(12) United States Patent
Liu et al.

(10) Patent No.: US 10,358,307 B1
(45) Date of Patent: Jul. 23, 2019

(54) LEADING/TRAILING EDGE DETECTION SYSTEM HAVING VACUUM BELT WITH PERFORATIONS

(71) Applicant: Xerox Corporation, Norwalk, CT (US)

(72) Inventors: Chu-heng Liu, Penfield, NY (US); Paul J. McConville, Webster, NY (US); Jason M. LeFevre, Penfield, NY (US); Douglas K. Herrmann, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 5 days.

(21) Appl. No.: 15/938,613

(22) Filed: Mar. 28, 2018

(51) Int. Cl.

| | |
|---|---|
| ***B65H 5/22*** | (2006.01) |
| ***B41J 11/00*** | (2006.01) |
| ***G03G 15/00*** | (2006.01) |
| ***B65H 9/20*** | (2006.01) |

(52) U.S. Cl.
CPC ..... *B65H 5/224* (2013.01); *B41J 11/007* (2013.01); *B41J 11/0095* (2013.01); *B65H 9/20* (2013.01); *G03G 15/5029* (2013.01); *G03G 15/6529* (2013.01); *G03G 15/6558* (2013.01); *B65H 2406/3223* (2013.01); *B65H 2553/412* (2013.01); *B65H 2553/416* (2013.01); *G03G 2215/00561* (2013.01); *G03G 2215/00616* (2013.01)

(58) Field of Classification Search
CPC ..... B65H 5/224; B65H 2553/412; B65H 2553/416; B65H 2406/3223
See application file for complete search history.

(56) References Cited

U.S. PATENT DOCUMENTS

| | | | | |
|---|---|---|---|---|
| 3,416,659 | A * | 12/1968 | Linderman | G01N 21/9072 209/565 |
| 4,294,539 | A * | 10/1981 | Spehrley, Jr. | G03B 27/64 198/689.1 |
| 4,298,277 | A | 11/1981 | Silverberg | |
| 4,544,265 | A * | 10/1985 | Powers | G03B 27/64 355/76 |
| 5,204,620 | A | 4/1993 | Costanza et al. | |
| 6,137,989 | A | 10/2000 | Quesnel | |
| 6,328,439 | B1 | 12/2001 | Rhodes | |
| 7,922,174 | B2 | 4/2011 | Panides et al. | |
| 2009/0262352 | A1 * | 10/2009 | Trilling | B65H 23/0216 356/429 |
| 2011/0103928 | A1 * | 5/2011 | Holbrook | B41J 11/007 414/752.1 |
| 2012/0148322 | A1 | 6/2012 | de Jong | |

* cited by examiner

*Primary Examiner* — Howard J Sanders
(74) *Attorney, Agent, or Firm* — Gibb & Riley, LLC

(57) ABSTRACT

A vacuum belt has perforations between belt edges. Some perforations in the vacuum belt are arranged in a pattern. The vacuum belt is positioned adjacent the media supply in a location to move sheets of the print media from the media supply. A light sensor is positioned in a location to detect light passing through the vacuum belt. The light sensor detects a portion of the vacuum belt as limited by an aperture area of the vacuum belt, and the pattern of perforations, and the size and location of the aperture area of the vacuum belt causes the signal output by the light sensor to be constant when the sheets are outside the aperture area of the vacuum belt.

20 Claims, 11 Drawing Sheets

LEADING/TRAILING EDGE DETECTION SYSTEM HAVING VACUUM BELT WITH PERFORATIONS

BACKGROUND

Systems herein generally relate to devices that detect the leading/trailing edge of sheets of media, and more particularly to detection systems that have a vacuum belt with perforations.

Vacuum belts are often used to transport sheets of material, such as sheets of paper, plastic, transparencies, card stock, etc., within printing devices (such as electrostatic printers, inkjet printers, etc.). Such vacuum belts have perforations (which are any form of holes, openings, etc., through the belt), that are open to a vacuum manifold through which air is drawn. The vacuum manifold draws in air through the perforations, which causes the sheets to remain on the top of the belt, even as the belt moves at relatively high speeds. The belt is generally supported between two or more rollers (one or more of which can be driven) and are commonly used to transport sheets from a storage area (e.g., paper tray) or sheet cutting device (when utilizing webs of material) to a printing engine.

In addition, printers improve performance by detecting locations of the leading and trailing edges of the sheets of media. For example, this allows the printing engine to properly align printing on the sheet of media, and avoids applying marking materials (e.g., inks, toners, etc.) to the belt itself. Common sheet edge detection devices include reflective light sensors (e.g., laser sensors) or similar devices; however, such light sensors may not always detect the sheet edges properly, especially when there is little difference between the color, or appearance, of the sheet and the belt because such sensors measure the contrast between the black media transport belt and the white media edge. Problems arise when colored media, such as greys and browns, are used and where the contrast between the media and the belt is not sufficient to properly trigger the sheet edge.

SUMMARY

Devices herein can be, for example, a printing apparatus that can include, among other components, a media supply storing print media, a vacuum belt having perforations between belt edges, a vacuum manifold positioned below the vacuum belt in a location to draw air through the perforations, a print engine positioned adjacent the vacuum belt in a location to receive sheets from the vacuum belt. The vacuum belt is positioned adjacent the media supply in a location to move sheets of the print media from the media supply.

Some perforations in the vacuum belt are aligned in rows that are at a non-perpendicular angle (acute or obtuse) to the belt edges. Additionally, such structures include a light source on a first side (e.g., bottom) of the vacuum belt, and a light sensor on a second side (e.g., top) of the vacuum belt in a position to detect the light output by the light source passing through the vacuum belt. The light detected by the light sensor is limited by an aperture intersecting the vacuum belt. Further, the non-perpendicular angle of the rows, and the size and location of the aperture area of the vacuum belt causes the signal output by the light sensor to be constant when the sheets are outside the aperture area of the vacuum belt.

The size and location of the aperture causes the portion of the vacuum belt within the aperture to always include the same total number of perforations, as the vacuum belt moves past the light sensor. Further, because the same total number of perforations are always measured by the light sensor, when no sheets are in the aperture area of the vacuum belt, this causes the signal output by the light sensor to be constant. Also, this total number of perforations is a summation of perforations that are completely within the aperture area of the vacuum belt, and those portions of the perforations that are partially within the aperture area of the vacuum belt. The size and position of the aperture is different for different patterns of the perforations, in order to cause the signal output by the light sensor to be constant.

The aperture can be a physical aperture (a light limiting shape), or an electronically created aperture. Alternatively, the aperture can be created using a focusing mirror positioned on the bottom of the vacuum belt. The light source is positioned between the focusing mirror and the vacuum belt. The focusing mirror directs the light from the light source through the perforations and focuses the light on a focal point on the top of the vacuum belt. In this situation, a single point light sensor can be positioned at the focal point on the top side of the vacuum belt. Such a single point light sensor detects a portion of the vacuum belt as limited by the aperture intersecting the vacuum belt that is created by the focusing mirror.

These structures also include a processor that is electrically connected to the light sensor. The processor detects that a sheet is present within the aperture portion of the vacuum belt when the signal output by the light sensor changes (e.g., decreases close to zero, such as a greater than 90% decrease in light signal). This processor identifies when edges of the sheet are aligned with a synchronization mark based on a partial (e.g., 50%) drop in the signal output by the light sensor.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
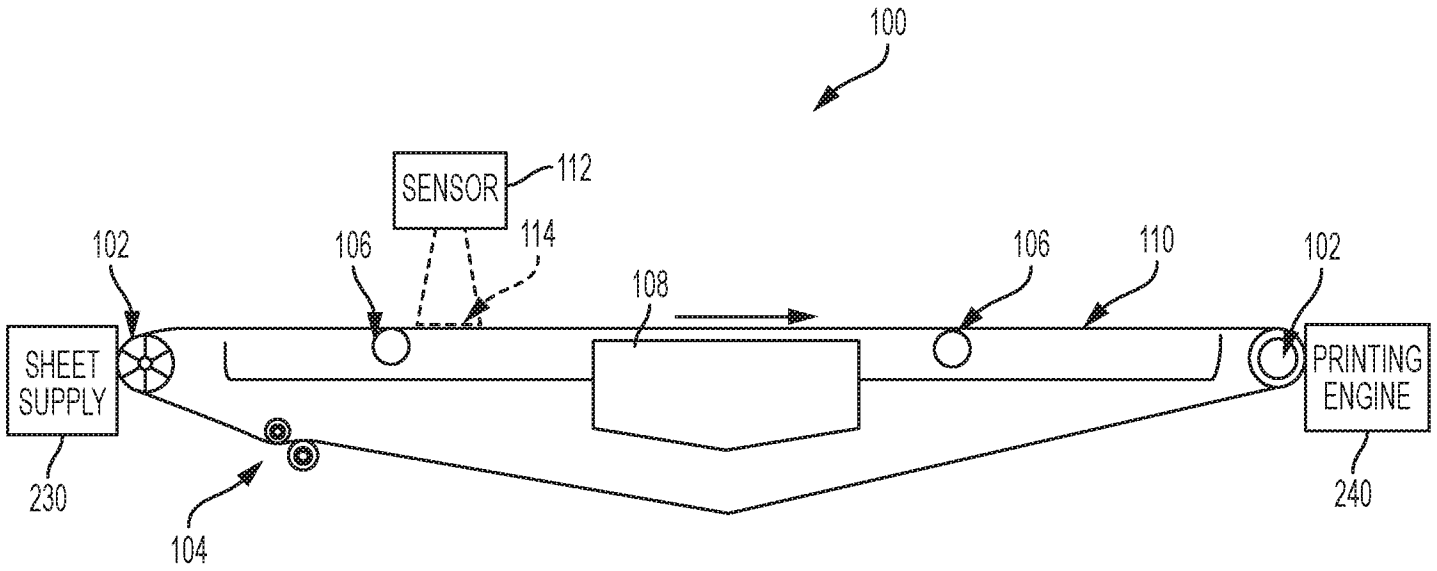
FIG. 1 is a side-view schematic diagram illustrating a media path herein.

As mentioned above, within systems that sense leading/trailing edges of sheets on vacuum belts, reflective light sensors may not always detect the sheet edges properly, especially when there is little difference between the color, or appearance, of the sheet and the belt. Therefore, some systems include a light source below the vacuum belt, and this allows the light sensor to locate the leading/trailing edges of the media sheets based on which perforations are blocked by the sheet on the belt.

However the pattern of, and spacing between, the perforations in the vacuum belt can result in solid, unbroken areas of the vacuum belt through which no light passes, which are sometimes referred to herein as "blind spots." Such blind spots are areas where there are not any perforations. Because there are no perforations in the blind spots, no light ever shines through these unbroken areas of the vacuum belt. The light sensor cannot detect a decrease in light level in the blind spots (because the light level is zero), which prevents the leading/trailing edges of the sheets from being accurately detected by the light sensor when sheet edges are positioned in a blind spot. The blind spots are therefore black zones with zero light transmission, which prevent the light sensor from being able to resolve the paper edge positions.

In view of this, the systems and methods herein provide a page synchronization sensing system that avoids such blind spots. More specifically, the structures herein use a vacuum transport belt with hole patterns and sensor aperture arranged in such a way that no blind-spot exists, and so that the sensor outputs a uniform signal when the belt moves past the light source and sensor. With these structures, the signal output by the sensor is continuous and smooth, in the absence of paper obstruction, and this allows the light sensor to respond to leading/trailing edges immediately and accurately. In other words, when a conventional reflective sensor (light source and the sensor are on the same side of the belt) is used, this presents a challenge when sensing dark papers, and therefore a specific combination of belt perforations and sensor aperture are used herein to overcome this limitation, without being hindered by the belt obstructions (blind spots).

In greater detail, the optical transmission sensor has a slot aperture. This aperture is the area of the vacuum belt that the light sensor detects. The aperture is rectangular, and can have two relatively longer sides that are perpendicular to the belt edges, and two relatively shorter sides that are parallel to the belt edges. Note that the aperture can be a physical aperture, can be created by using signals from a limited set of less than all the pixels of the light sensor, can be created using concave mirrors to focus light on a point sensor, etc. The aperture can be approximately centered between the belt edges, and the dimensions of the aperture are selected to cause the sensor to always sense the same number of perforations.

Further, the hole/perforation pattern of vacuum belts used by devices herein have holes arranged in a regular pattern such that there are always the same number (or partial number) of holes under the aperture, to eliminate blind-spots. In some implementations, the holes are slightly elongated along the process direction (oval) and the aperture can be, for example, sufficiently wide in the process direction to include a portion (e.g., 5%, 10%, 20%, etc.) perforations, which provides light transmission from below the vacuum belt that is nearly constant within the area of the aperture.

With respect to the vacuum belt, such belts are often referred to as "continuous" belts because the ends of the (otherwise rectangular) strips of material that make up the belt are joined together at a location referred to as the belt seam. The belt seam is perpendicular to the belt edges, and is perpendicular to the direction in which the belt moves when the supporting rollers rotate (which is the process direction). The belt seam may not include perforations. In order to provide proper leading/trailing edge detection, a seamless belt can be used. In other alternatives, the area of the seam can be formed to include perforations, so as to again avoid blind spots. In other alternatives, the devices can avoid locating the leading/trailing edges at the belt seam using knowledge of seam location, with upstream sensors that avoid locating the leading/trailing edges on the belt seam.

With these structures, the leading/trailing edges of sheets are reliably and accurately detected, even with colored papers and pre-printed forms. Further, the vacuum transport belt still maintains its functional performance and mechanical integrity. Also, these improvements are inexpensive, and use established sensing technology, and existing electronics and software for triggering and controls.

Therefore, devices herein can be, for example, a printing apparatus (shown in FIG. 7, and discussed in detail below) that can include, among other components (as shown in FIG. 1) a media supply 230 storing print media, a media path 100 having a vacuum belt 110 having perforations 120 between the belt edges 116, and a vacuum manifold 108 positioned adjacent (below) the vacuum belt 110 in a location to draw air through the perforations 120. As shown in FIG. 1, the vacuum belt 110 is supported between rollers 102, at least one of which is driven, and the belt is kept under proper tension using tensioning rollers 104.

The generic media supply 230 shown in the accompanying drawings can include various elements such as a paper tray, feeder belts, alignment guides, etc., and such devices store cut sheets, and transport the cut sheets of print media to the vacuum belt 110. Also, a print engine 240 is positioned adjacent the vacuum belt 110 in a location to receive sheets from the vacuum belt 110, a light sensor 112 is positioned adjacent the vacuum belt 110 in a location to obtain the light being output by the light source 106 through the vacuum belt 110, and a processor 224 (FIG. 7) is electrically connected to the light sensor 112, etc.

The side of the vacuum belt 110 where the manifold 108 is located is arbitrarily referred to herein as the "bottom" of the vacuum belt 110, or the area "below" the vacuum belt 110. Conversely, the side of the vacuum belt 110 where the light sensor 112 is located is arbitrarily referred to herein as the "top" of the vacuum belt 110, or the area "above" the vacuum belt 110. However, despite these arbitrary designations, the device itself can have any orientation that is useful for its intended purpose.

As also shown in FIG. 1, the light source 106 is adjacent (below) the vacuum belt 110, and is on the same side of the vacuum belt 110 as the vacuum manifold 108. In other words, the vacuum belt 110 is between the light sensor 112 and the light source 106, causing the light to pass through the perforations 120 in the vacuum belt 110 to the light sensor 112, reliably allowing the light sensor 112 to identify when the sheets block the perforations 120 (and when they do not) in the signal output by the light sensor 112. As shown in FIG. 1, the vacuum belt 110 is positioned adjacent the media supply 230 in a location to move the sheets of the print media from the media supply 230.

Figure 2:
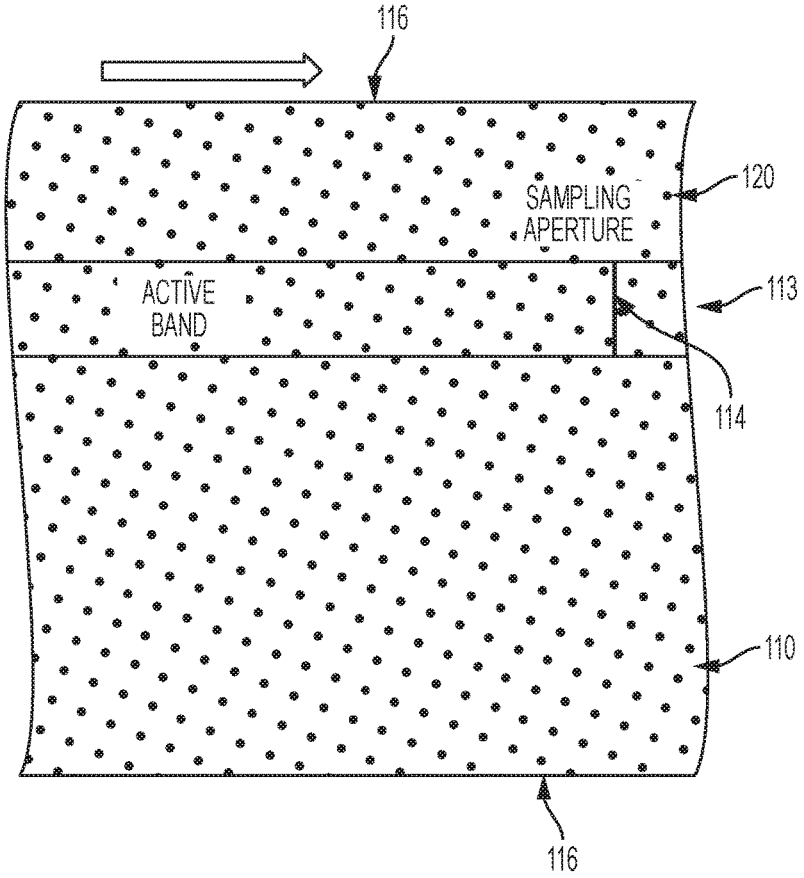
FIGS. 2-5C are a top-view schematic diagram illustrating a vacuum belt herein.

While FIG. 1 shows a side view of the media path 100, FIG. 2 is a schematic diagram illustrating a top view (plan view) of the belt 100 that is rotated 90° relative to FIG. 1. FIG. 2 illustrates the holes/perforations 120 that are openings through the belt 110, the belt edges 116, and the processing direction (represented by a block arrow) which is the direction in which the belt 110 travels.

FIG. 2 also illustrates the aperture 114 which is the only region of the belt 110 from which the sensor 112 (FIG. 1) receives light. As the belt 110 moves in the processing direction (arrow) by the sensor 112, the sensor detects the amount of light passing through an active band 113. In other words, the active band 113 is the portion of the belt that passes through the aperture area 114 (e.g., the portion of the belt 110 through which the light that is detected by the sensor 112 passes).

Figure 3:
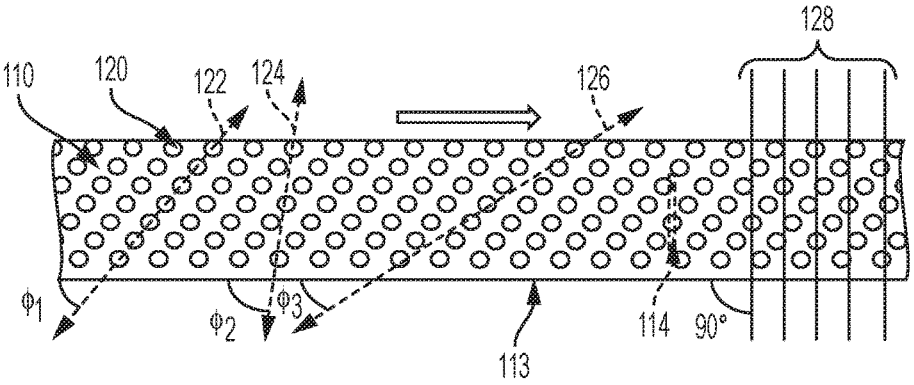

FIG. 3 is again a top view (plan view) and illustrates an expanded view of the active band 113. As shown, the perforations 120 in the vacuum belt 110 can be aligned in rows 122, 124, 126. As shown in FIG. 3, the rows 122, 124, 126 can be aligned at acute angles $Ø_1$, $Ø_2$, and $Ø_3$, (or a complementary obtuse angles) to the edges of the active band 113 (and to the belt edges 116). Thus, as shown in FIG. 3, some rows 122, 124, 126, formed by the perforations can be non-perpendicular (although some rows of perforations could be perpendicular) to the edges of the active band 113 (and to the belt edges 116).

Because of the angle of the rows 122, 124, 126 and the spacing and size of the perforations, all lines perpendicular to the edges of the active band 113 (and to the belt edges 116) intersect at least one of the perforations 120. This is shown in FIG. 3 where all lines 128 perpendicular to the edges of the active band 113 (and to the belt edges 116) intersect at least one of the perforations 120. Thus, as shown by the edge-perpendicular lines 128, the acute/obtuse angle of the rows 122, 124, 126 and the spacing and size of the perforations 120 causes at least one of the perforations 120 to intersect all lines 128 that are perpendicular to the edges of the active band 113 (and to the belt edges 116), thereby preventing any "blind-spots" in the cross-process direction (perpendicular to the belt edges 116).

Figure 4:
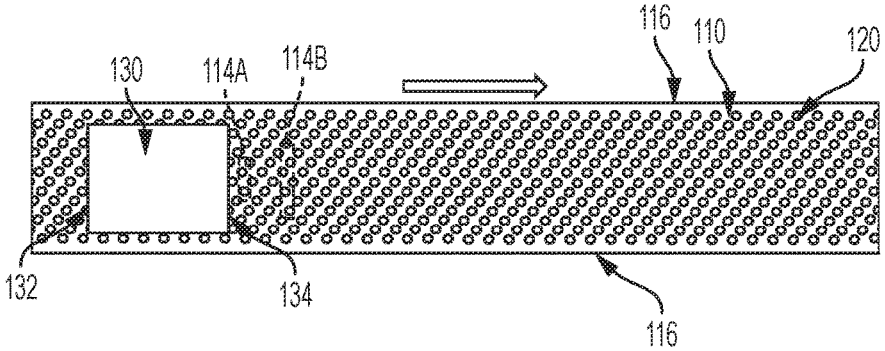

FIG. 4 is similarly a top view (plan view) of the belt 110. FIG. 4 illustrates some alternative apertures 114A and 114B, which are different rectangles (e.g., different width rectangles). Therefore, as shown in FIG. 4, the light sensor 112 (FIG. 1) acquires the light from the area of the belt 110 corresponding to the aperture 114A or 114B. Also, FIG. 4 shows a sheet 130 on the belt 110 blocking some of the openings 120 from passing light in aperture 114A. As can also be seen in FIG. 4, the aperture 114A or 114B can be centered between the belt edges 116, or can be located at non-centered locations, depending upon specific implementation.

Aperture 114B is a rectangle having relatively longer sides that are perpendicular to the processing direction (and perpendicular to the belt edges 116). In this example, the relatively longer sides the aperture 114B are perpendicular to the belt edges 116, and are long enough to cause the image output by the light sensor 112 to include a portion (e.g., 5%, 10%, 20%, etc.) of the perforations in the cross-processing direction. The relatively shorter sides of the aperture 114B rectangle are parallel to the belt edges 116, and can be long enough to cause the signal output by the light sensor 112 to include a portion (e.g., 0.5%, 1%, 2%, etc.) of the perforations in the processing direction.

Note that the sizes of the apertures 114 in the Figures are sometimes exaggerated relative to the perforations 120 and belt 110, and are shown as wide rectangles. Such exaggeration is used to illustrate the feature that the same number, or partial number, of perforations 120 will always be within the aperture 114, regardless of belt 110 position. In practice, the aperture 114 could be a very narrow line segment of a few millimeters wide, which can be a slot or even a single slit.

Figure 5A:
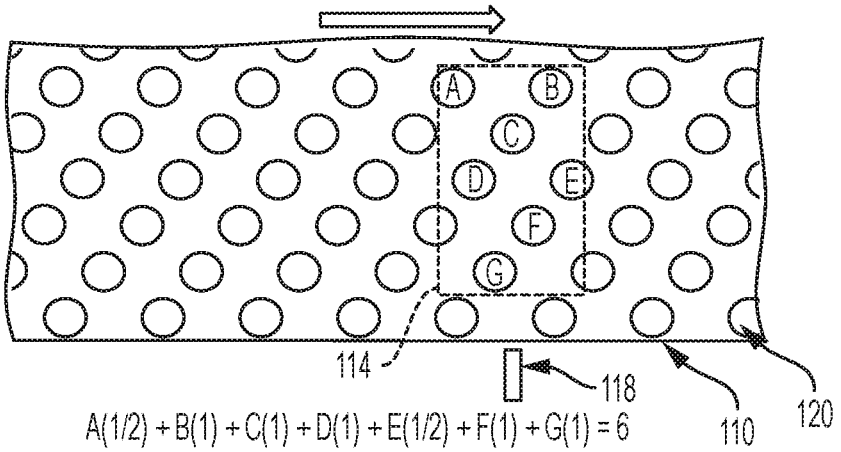
Figure 5B:
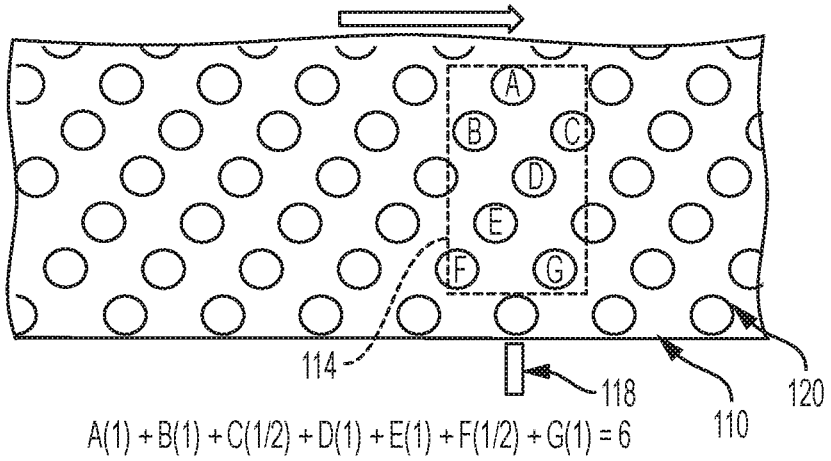

FIGS. 5A-5B present a rectangular aperture 114 that is sized to illustrate that the pattern of belt perforations 120 in combination with the size, shape, and cross-process belt location of the aperture 114 produces a consistent signal from the sensor 112 as the belt 110 moves past the sensor 112; however, the actual aperture 114 could have a different size/shape/location. FIGS. 5A and 5B illustrate the same view of the same structure; however, the belt 110 is in different positions in FIGS. 5A and 5B, causing the perforations 120 to be in different positions relative to the aperture 114. More specifically, the belt 110 has moved in the processing direction (arrow) in FIG. 5B relative to FIG. 5A.

With structures herein, the size, shape, and cross-process belt location of the aperture 114 is established so that (in the absence of any sheet blocking any of the perforations 120 within the aperture 114) the same amount of light reaches the sensor 112, irrespective of belt 110 location. In this example, some of the perforations 120 are identified using letters A-G in FIGS. 5A-5B; however, each letter designations does not relate to the same perforation 120, but instead each letter only relates to a perforation that is within the aperture 114, which changes with belt 110 position.

In FIG. 5A, half of perforations A and E are outside the aperture 114, and all of perforations B, C, D, F, and G are within aperture 114. In contrast, in FIG. 5B, because the belt 110 is in a different position, half of perforations C and F are outside the aperture 114, and all of perforations A, B, D, E, and G are within aperture 114. However, as shown by the addition (summation equation) within FIGS. 5A-5B, each aperture 114 includes the equivalent of 6 full perforations. Specifically, in FIG. 5A, each lettered perforation has been given a perforation value (either 1 or ½ perforation), resulting in 6 full perforations within the aperture 114 (e.g., A (½ perforation)+B (1 perforation)+C (1 perforation)+D (1 perforation)+E (½ perforation)+F (1 perforation)+G (1 perforation)=6 full perforations). Similarly, in FIG. 5B, there are also 6 full perforations within the aperture 114, even though the belt 110 is in a different position (e.g., A (½ perforation)+B (1 perforation)+C (1 perforation)+D (1 perforation)+E (½ perforation)+F (1 perforation)+G (1 perforation)=6 full perforations).

Therefore, perforations 120 in the vacuum belt 110 are aligned in rows that can be at a non-perpendicular angle (acute or obtuse) to the active band 113 (and to the belt edges 116). Additionally, the light detected by the light sensor 112 is limited by the aperture 114 intersecting the vacuum belt 110 (which defines the aperture area 114 of the vacuum belt 110). Further, the arrangements of the rows, and the size and location of the aperture area 114 of the vacuum belt causes the signal output by the light sensor 112 to be constant when the sheets 130 are outside the aperture area 114 of the vacuum belt 110. In practice, the non-perpendicular angle arrangements of the rows can reduce the constraints on the choices of the hole sizes and aperture dimensions.

In other words, the size and location of the aperture 114 causes the portion of the vacuum belt 110 within the aperture area 114 to always include the same total number of perforations 120 (e.g., 6 full perforations) as the vacuum belt 110 moves past the light sensor 112. Further, because the same total number of perforations 120 are always measured by the light sensor 112, when no sheets 130 are in the aperture area 114 of the vacuum belt 110, this causes the signal output by the light sensor 112 to be constant. Also, this total number of perforations 120 is a summation of perforations 120 that are completely within the aperture area 114 of the vacuum belt 110 (FIG. 5A: B, C, D, F, and G; FIG. 5B: A, B, D, E, and G) and those portions of the perforations 120 that are partially within the aperture area 114 of the vacuum belt 110 (FIG. 5A; A and E; FIG. 5B: C and F). The size and position of the aperture is different for different patterns of the perforations, in order to cause the signal output by the light sensor to be constant.

In one example, the length (in the cross-process direction) of the aperture 114 can be selected so that only full perforations 120 will be included where the extremes of the length are located (the ends in the length direction) to maintain a constant sensor signal. In other words, by avoiding having partial perforations 120 along the length ends of the aperture that are parallel to the belt edges, this eliminates partial perforations 120 in the cross-process direction, and helps maintain a constant sensor signal.

The location (in the cross-process direction) and shape of the aperture 114 can also be established during calibration and/or empirical testing to always provide a constant sensor signal. Further, such settings of size/shape/location of the aperture 114 are changed based on the specific pattern of perforations 120 in the belt 110. In other words, the perforations eliminate blind spots (in the process direction) and the size/shape/location of the aperture ensures a smooth, constant sensor signal. Thus, the size and position of the aperture 114 is different for different patterns of the perforations 120, in order to cause the signal output by the light sensor 112 to be constant.

Figure 5C:
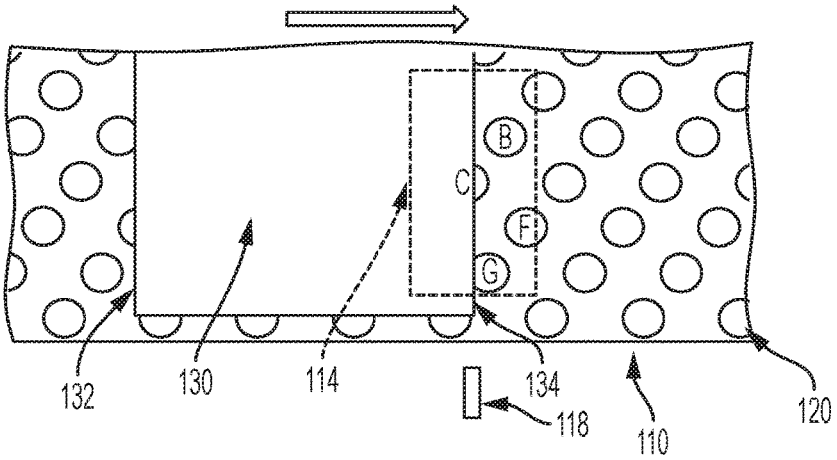

FIG. 5C shows the same view as FIGS. 5A-5B, with perforations 120 within the aperture 114 being identified by letter. However, FIG. 5C also shows a leading edge 134 (132 is the trailing edge) of a media sheet 130 blocking some perforations in the aperture 114; and FIG. 6 is a graph of the signal 154 output by the sensor 112 when some of the perforations 120 are blocked by the sheet 130.

Figure 6A:
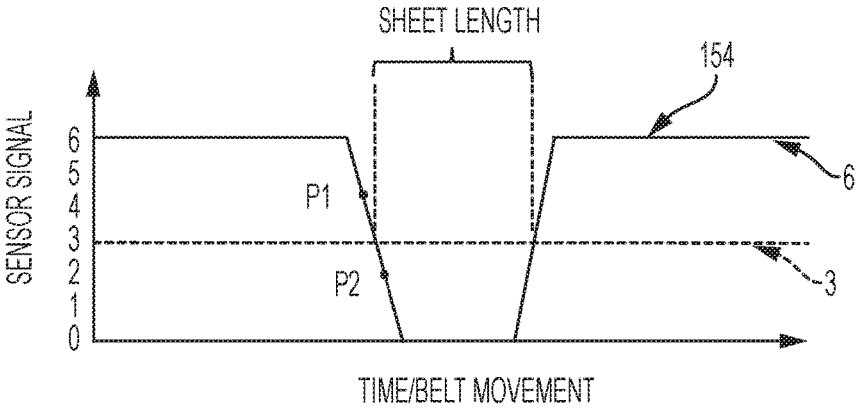
FIG. 6A-6C is a graph showing a sensor signal produced by structures and methods herein.

More specifically, FIG. 6A shows the signal level on the left (Y) axis, and time (or amount of belt movement, which occurs over time) on the right (X) axis. The signal level is in arbitrary units that correspond to full perforations (e.g., 6 perforations to remain consistent with the previous discussion). FIG. 6 shows that, in the absence of sheets 130 blocking perforations 120, a constant signal corresponding to 6 full perforations 120 is output by the sensor 112. However, when the leading edge 134 of the media sheet 130 begins to cross the aperture 114, a portion of some of the perforations 120 is blocked, decreasing the light reaching the sensor 112, and this is shown in FIG. 6A where the sensor signal 154 begins to drop over time. At some time or belt position, all perforations 120 within the aperture 114 are covered by the sheet 130, and the sensor signal 154 drops to its lowest calibrated level (e.g., zero, or close to zero, in this example, but the lowest level could be higher than 0, and depends upon what the sensor 112 detects when calibrated with all perforations 120 in the aperture 114 blocked). At a later time or belt position, the trailing edge 132 passes into the aperture 114 and begins to reveal portions of some of the perforations 120, and as shown in FIG. 6A, the sensor signal 154 begins to increase.

In order to have accurate determination of the paper edge, better than the width (along the process direction) of the sampling window, the light transmission signal has to transition from high to low (or low to high) in a smooth fashion, or preferably, at a constant rate (constant slope in FIG. 6A), which is an improvement of the constant sum of hole areas as illustrated by FIGS. 5A-5C. In other words, constant light transmission in the absence of the paper is necessary but not sufficient for the accurate determination of the paper edge (better accuracy than the width of the sampling window).

Figure 6B:
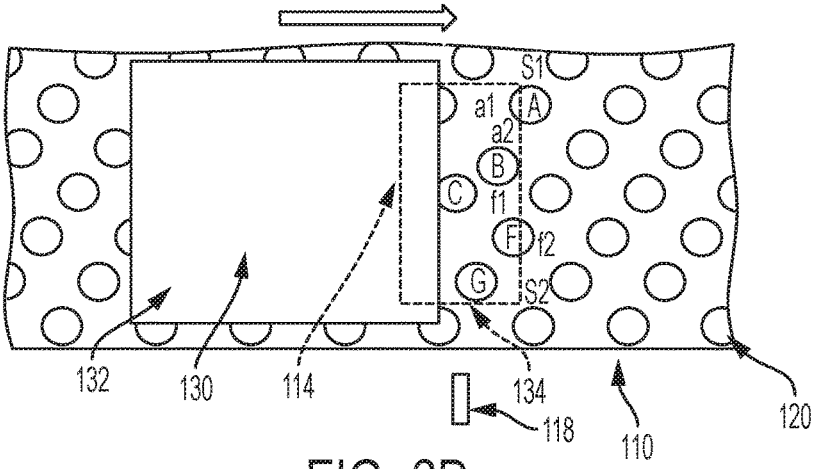
Figure 6C:
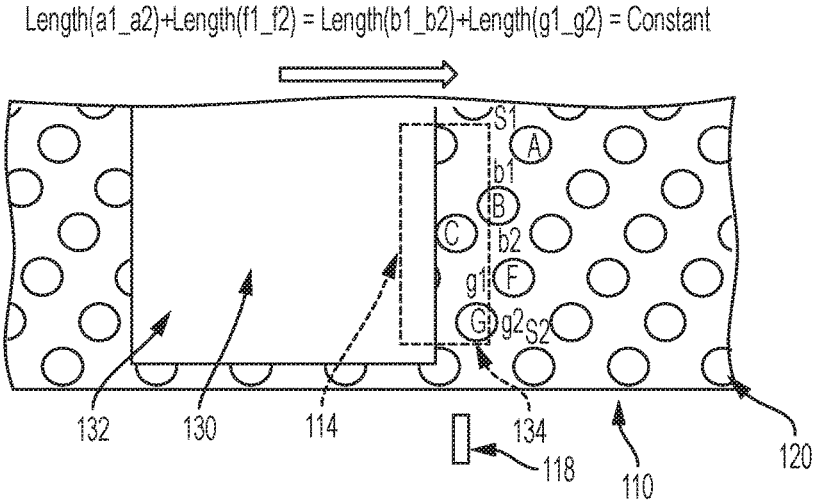

To accurately determine the paper edge position within the sampling window, a stricter condition is to be satisfied. FIG. 6A, with FIGS. 6B and 6C, respectively illustrate the configurations corresponding to two positions P1 and P2. As the paper and belt travel together, moving pass the sampling window, the amount of light is decreasing as more hole opening area is moving out of the sampling window. The rate of this change (the slope of the curve in the transition regions of FIG. 6A) is proportional to the sum of the intersections of the sampling window edge in the cross-process direction S1_S2, with the belt holes. At position P1 which is illustrated by FIG. 6B, S1_S2 intersects hole A at a1_*a*2 and hole F at f1_*f*2. At position P2 which is illustrated by FIG. 6C, S1_S2 intersects hole B at b1_*b*2 and hole G at g1_*g*2. To guarantee a constant slope of the light transmission throughout the passage of the paper edge, the following should be satisfied:

$$\text{Length}(a1_a2)+\text{Length}(f1_f2)=\text{Length}(b1_b2)+\text{Length}(g1_g2)=\text{Constant}$$

Because the belt is constantly moving pass the sampling window and the relative position of paper with respect to the belt is random, this constant sum of intersections should be maintained through the whole belt length (along the process direction).

One implication of this constant sum of the intersecting segments between the belt holes and the sampling window edges (in the cross process direction) is that the sampling widow can have any widths and positions along the process direction and the condition of the constant sum of the hole areas within the aperture will be automatically satisfied. In practice, the choice of the aperture width is determined by allowing a sufficient amount light to pass through the aperture while maintaining a sufficiently steep slope when paper passes by.

A useful data item is identification of when the leading edge 134 or trailing edge 132 of the sheet 130 is aligned with a synchronization trigger mark 118. During calibration, a sheet 130 can be manually or automatically aligned with the synchronization trigger mark 118, and the output from the sensor 112 with the sheet 130 in this position is measured and recorded. This calibrated value of the sensor signal is then used to identify when the leading or trailing edge (134, 132) of the sheet is aligned with the synchronization trigger mark 118.

Continuing with the previous simplistic example, a calibration procedure may determine that the leading and trailing edges 134, 132 of the sheet aligned with the synchronization trigger mark 118 causes 50% of perforations 120 within the aperture to be blocked, resulting in a sensor signal 154 level of 3 units to be output from the sensor 112. This is shown in FIG. 6 where the "Sheet Length" relative to the synchronization trigger mark 118 occurs between the locations of where the sensor signal 154 crosses the level of 3. Therefore, the devices and methods herein avoid any blind spots, which allows precise identification of when the leading or trailing edge 134, 132 is aligned with the synchronization trigger mark 118 (e.g., sensor signal level 3) using a backlit perforated belt 110 to avoid belt/media confusion.

Further, because of the combination of the belt perforation 120 pattern and the size/shape/location of the aperture 114, as the belt 110 moves past the sensor 112 the same number (e.g., 6) or the same total area of perforations of light will always reach the sensor 112, resulting in a consistent, smooth signal output from the sensor 112. In practice, this total area of perforation within the aperture can be fractional of the whole holes. Note that the signal that is output from the sensor 112 can be in any units appropriate for the sensor 112 (e.g., volts, millivolts, lumens, lux, etc.). Calibration procedures thus determine the level of a constant sensor 112 output signal, and deviation from that calibrated signals represents the presence of a sheet of media 130 on the belt 110 blocking some of the perforations 120. For example, a partial drop (e.g., 40%, 50%, 60%, etc., drop in sensor signal) may indicate a leading/trailing edge 132, 134; while of full drop (e.g., greater than 90%, in sensor signal) may represent the portions of the sheet 130 between the sheet edges 132, 134.

Figure 7A:
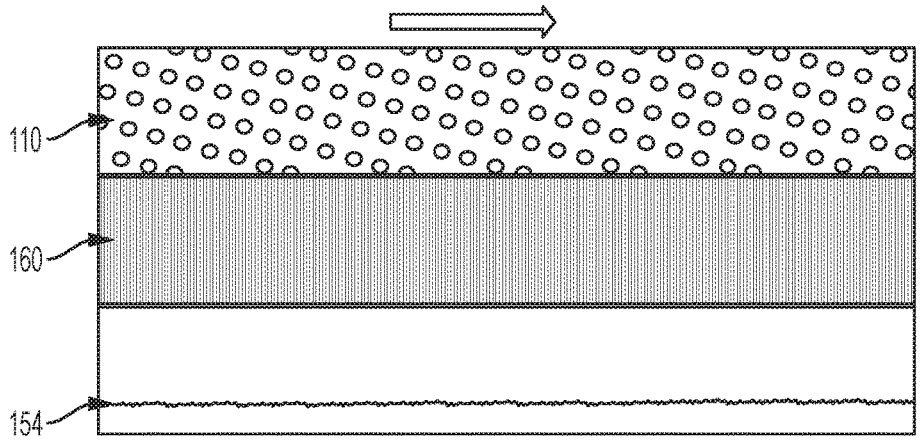
FIGS. 7A-7B are conceptual schematic diagrams illustrating light penetration through vacuum belts with structures herein.
Figure 7B:
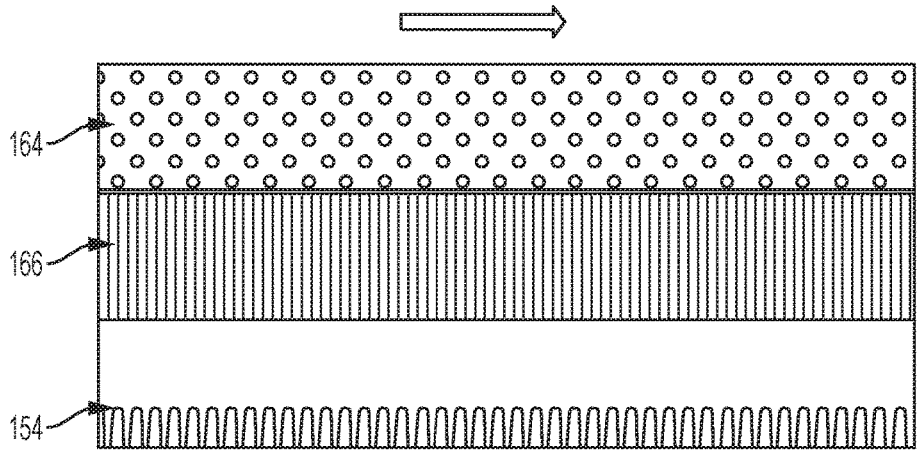

FIGS. 7A-7B conceptually shown the constant sensor signal 154 resulting from the combination of perforation 120 pattern and size/shape/location of the aperture 114. More specifically, element 110 in FIG. 7A conceptually represents the belt, item 160 represents light passing through the aperture 114 over time, and item 154 again represents the sensor signal 154. In FIG. 7B, a conventional belt with perpendicular rows of apertures (with spaces between the rows being blind spots) is represented conceptually as item 164, the light passing through the perforations in belt 164 over time as shown as item 166, and again item 154 is the sensor signal.

As can be seen in FIG. 7B, even in the absence of a sheet blocking perforations, the light 166 alternates between light and dark as the blind spots pass by the sensor. This results in a square wave sensor signal 154 output by the sensor. In contrast, in FIG. 7A, because the combination of belt pattern with angled rows 122, 124, 126 of perforations 120, and the size/shape/location of the aperture 114, there are no blind spots, which results in a constant, unwavering, smooth sensor signal 154 being output by the sensor 112.

Figure 8:
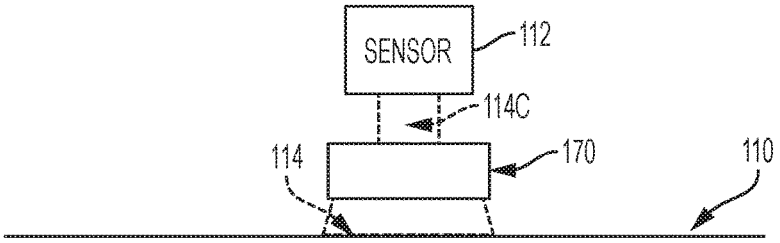
FIGS. 8 and 9 are side-view schematic diagrams illustrating apertures formed by structures and methods herein.

The aperture 114 can be created using physical structures (material having rectangular openings, etc.), or by filtering which pixels of an array sensor 112 are used. For example, as shown in FIG. 8, a physical filter 170 can restrict the aperture 114 to a smaller aperture 114C. In a similar way, a limited number of pixels within the sensor 112 can be activated to electronically limit aperture.

Figure 9:
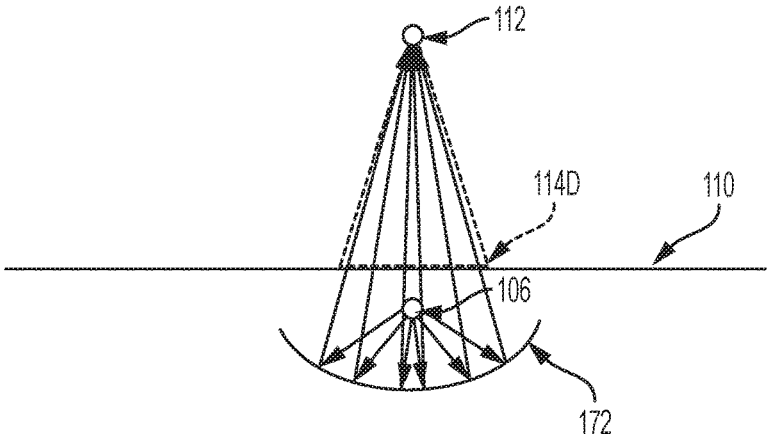

Additionally the aperture can be defined by using directed (parallel, diverging or converging) light beams. As shown in FIG. 9, the aperture is limited using a focusing mirror 172 (which can be concave cylindrical or spherical, for example) below the belt 110 that focuses the light output from the light source 106 to converge at a single point on the opposite side of the belt 110 to allow the sensor to be a point sensor 112. Therefore, with structures herein, point sensors can be used in addition to a traditional array sensor (e.g., full-width array (FWA) "imaging sensor"). Note that all possible types of sensors are identified in the drawings using generic identifier 112. Such a single point sensor 112 uses a "sampling aperture" 114 with extended size in the cross processing direction. Therefore, as shown, there are many different ways to achieve the "sampling aperture" herein.

With a focusing mirror 172, the light source 106 is positioned between the focusing mirror 172 and the vacuum belt 110. The focusing mirror 172 directs the light from the light source 106 through the perforations 120 and focuses the light on a single focal point on the top of the vacuum belt (at location 112). In this situation, a single point light sensor 112 can be positioned at the light converging point on the top side of the vacuum belt 110. Such a single point light sensor 112 detects a portion of the vacuum belt 110 as limited by the aperture 114 intersecting the vacuum belt 110 that is created by the focusing mirror 172.

Further, with a single point sensor 112, the processing is simplified relative to an array sensor, because the single point sensor 112 only detects a single point where the leading/trailing edge changes the signal being output (e.g., changes it from a continuous light signal to a continuous no-light signal (or vice versa)) which allows just the signal change to identify the leading/trailing edge, without analysis of an array image.

Thus, the aperture 114 can be a physical aperture (a structure having a light limiting opening), or an electronically created aperture (by using signals from a limited set of less than all the pixels of a light sensor). Alternatively, the aperture 114 can be created using directed light beams through a focusing mirror 172 positioned on the bottom of the vacuum belt 110.

As shown above, these structures do not have a blind spot, even when the aperture is a single line (a mathematical line that has no width created by the belt/sheet moving past a point) in the processing direction. Therefore, with structures herein, the apertures 114 can be very narrow, for example much less than the width a single row of holes. Further, the parallel or point aperture does not have to cover a significant part of the belt width. With the patterns of holes described herein, an aperture 114 that is only a few centimeters wide (across the process direction) produces good results.

Figure 10A:
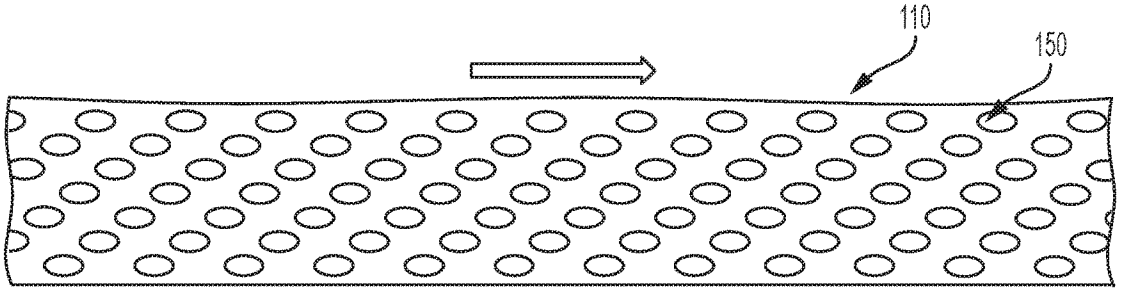
FIGS. 10A and 10B are top-view schematic diagrams illustrating a belt with oval perforations.
Figure 10B:
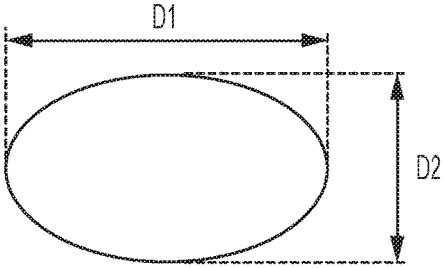

Also, as shown in FIGS. 10A-10B, the perforations 150 can also be oval. As shown in FIG. 10B, such oval perforations 150 have a relatively long diameter D1 and a relatively short diameter D2 that are perpendicular to each other, where the relatively long diameters D1 of the ovals 150 are parallel to the belt edges 116.

Figure 11:
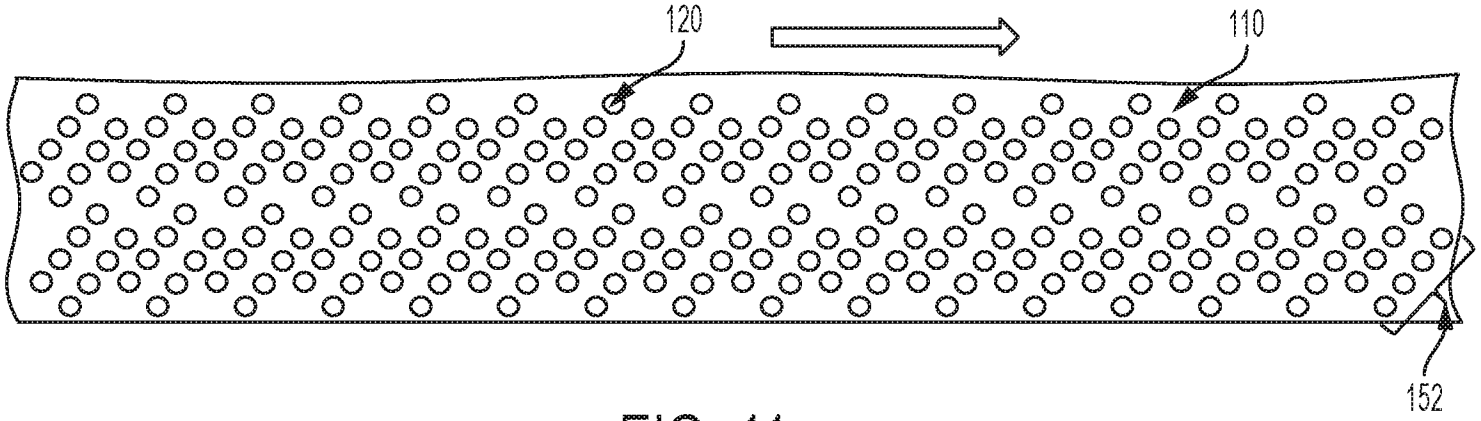
FIG. 11 is a top-view schematic diagram illustrating a vacuum belt herein.

FIG. 11 illustrates groups of offset rows 152 of perforations (which can be round or oval, as noted above) that similarly do not have blind spots. More specifically, the rows 152 shown in FIG. 11 each contain four perforations 120. The rows (or perforation sets) 152 are offset relative to the other rows 152. As with the previously discussed structures, the combination of the offset rows 152 does not have any blind spots. Thus, the acute/obtuse angle of the rows 152 of the perforations 120 causes at least one of the perforations 120 to intersect all lines that are perpendicular to the edge of the aperture 114, thereby preventing any "blind-spots" perpendicular to the process direction.

Figure 12:
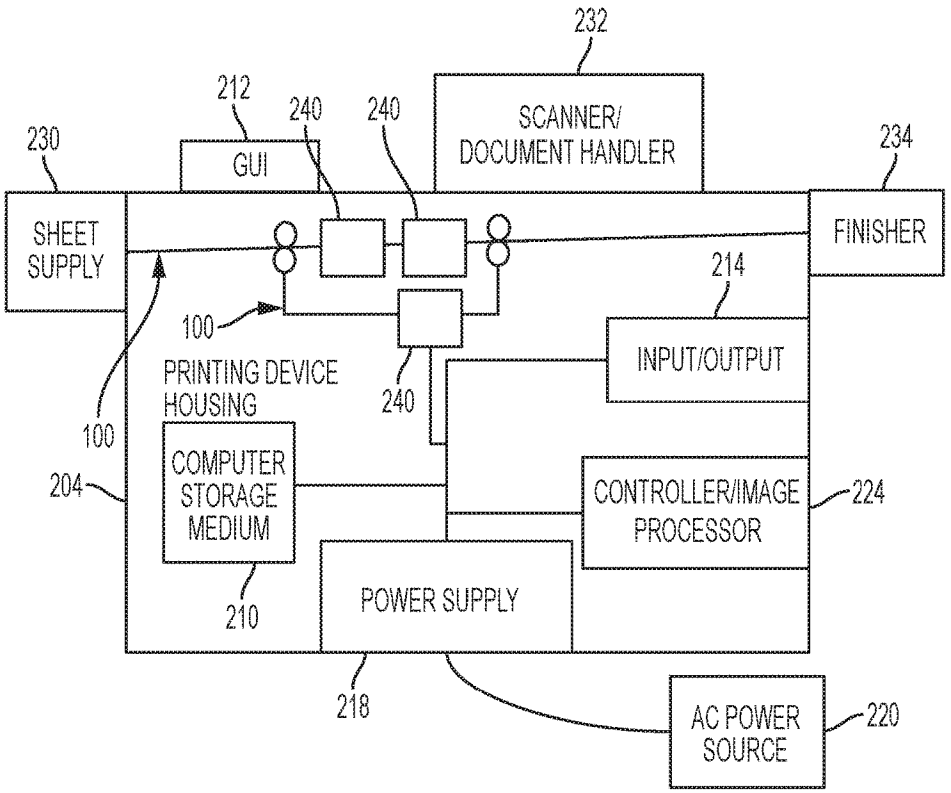
FIG. 12 is a schematic diagram illustrating printing devices herein.

FIG. 12 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

As noted previously, the processor 224 is electrically connected to the light sensor 112. The processor 224 detects that a sheet 130 is present within the aperture portion 114 of the vacuum belt 110 when the signal 154 output by the light sensor 112 changes (e.g., decreases close to zero, such as a greater than 90% decrease in light signal). The processor 224 identifies when edges 132, 134 of the sheet 130 are aligned with a synchronization mark 118 based on a partial (e.g., 40%, 50%, 60%, etc.) drop in the signal 154 output by the light sensor 112.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 12, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that use marking material, and are operatively connected to a specialized image processor 224 (that is different from a general purpose computer because it is specialized for processing image data), a media path 100 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

a media supply storing print media;

a vacuum belt having perforations between belt edges, at least some of said perforations in said vacuum belt are arranged in a pattern, and said vacuum belt is positioned adjacent said media supply in a location to move sheets of said print media from said media supply; and a light sensor positioned in a location to detect light passing through said vacuum belt, said light sensor includes a filter that limits which portion of said vacuum belt said light sensor detects to an aperture area of said vacuum belt, and said pattern of said perforations, and a size and location of said aperture area of said vacuum belt causes a signal output by said light sensor to be constant when said sheets are outside said aperture area of said vacuum belt area of said vacuum belt.

2. The printing apparatus according to claim 1, said size and location of said aperture area of said vacuum belt causes said aperture area of said vacuum belt to always include a same total area of perforations as said vacuum belt moves past said light sensor.

3. The printing apparatus according to claim 2, said same total area of perforations cause said signal output by said light sensor to be constant.

4. The printing apparatus according to claim 2, said same total area of perforations include a summation of perforations that are completely within said aperture area of said vacuum belt and perforations that are partially within said aperture area of said vacuum belt.

5. The printing apparatus according to claim 1, said size and location of said aperture area of said pattern of said perforations causes an edge of said aperture in a cross-process direction to intersect lengths of one or more of said perforations, and the sum of said lengths is a constant.

6. The printing apparatus according to claim 1, further comprising a processor that identifies when edges of said sheets are aligned with a synchronization mark based on a drop in said signal output by said light sensor, wherein said drop in said signal is at a constant rate of change.

7. The printing apparatus according to claim 1, further comprising a vacuum manifold positioned adjacent said vacuum belt in a location to draw air through said perforations.

8. A printing apparatus comprising:

a media supply storing print media;

a vacuum belt having perforations between belt edges, at least some of said perforations in said vacuum belt are arranged in a pattern, and said vacuum belt is positioned adjacent said media supply in a location to move sheets of said print media from said media supply;

a print engine positioned adjacent said vacuum belt in a location to receive said sheets from said vacuum belt;

a light source on a first side of said vacuum belt;

a light sensor positioned on a second side of said vacuum belt, opposite said first side, in a location to detect light from said light source passing through said vacuum belt, said light sensor includes a filter that limits which portion of said vacuum belt said light sensor detects to an aperture area of said vacuum belt, and said pattern of said perforations, and a size and location of said aperture area of said vacuum belt causes a signal output by said light sensor to be constant when said sheets are outside said aperture area of said vacuum belt; and a processor electrically connected to said light sensor, said processor detects a sheet within said aperture area of said vacuum belt when said signal output by said light sensor changes.

9. The printing apparatus according to claim 8, said size and location of said aperture area of said vacuum belt causes said aperture area of said vacuum belt to always include a same total area of perforations as said vacuum belt moves past said light sensor.

10. The printing apparatus according to claim 9, said same total area of perforations cause said signal output by said light sensor to be constant.

11. The printing apparatus according to claim 9, said same total area of perforations include a summation of perforations that are completely within said aperture area of said vacuum belt and perforations that are partially within said aperture area of said vacuum belt.

12. The printing apparatus according to claim 8, said size and location of said aperture area of said pattern of said perforations causes an edge of said aperture in a cross-process direction to intersect lengths of one or more of said perforations, and the sum of said lengths is a constant.

13. The printing apparatus according to claim 8, said processor identifies when edges of said sheet are aligned with a synchronization mark based on a drop in said signal output by said light sensor, wherein said drop in said signal is at a constant rate of change.

14. The printing apparatus according to claim 8, further comprising a vacuum manifold positioned adjacent said vacuum belt in a location to draw air through said perforations.

15. A printing apparatus comprising:

a media supply storing print media;

a vacuum belt having perforations between belt edges, at least some of said perforations in said vacuum belt are arranged in a pattern, and said vacuum belt is positioned adjacent said media supply in a location to move sheets of said print media from said media supply;

a print engine positioned adjacent said vacuum belt in a location to receive said sheets from said vacuum belt;

a light source on a first side of said vacuum belt;

a focusing mirror positioned on said first side of said vacuum belt, said focusing mirror being shaped and positioned to direct light from said light source through said perforations, and to focus said light on a focal point on a second side of said vacuum belt opposite said first side, said light source is positioned between said focusing mirror and said vacuum belt;

a single point light sensor positioned at said focal point on a second side of said vacuum belt, opposite said first side, in a location to detect said light passing through said vacuum belt, said single point light sensor detects a portion of said vacuum belt as limited by an aperture area of said vacuum belt created by a shape and position of said focusing mirror, and said pattern of said perforations, and a size and location of said aperture area of said vacuum belt causes a signal output by said single point light sensor to be constant when said sheets are outside said aperture area of said vacuum belt; and a processor electrically connected to said single point light sensor, said processor detects a sheet within said aperture area of said vacuum belt when said signal output by said single point light sensor changes.

16. The printing apparatus according to claim 15, said size and location of said aperture area of said vacuum belt causes said aperture area of said vacuum belt to always include a same total area of perforations as said vacuum belt moves past said single point light sensor.

17. The printing apparatus according to claim 16, said same total area of perforations include a summation of perforations that are completely within said aperture area of said vacuum belt and perforations that are partially within said aperture area of said vacuum belt.

18. The printing apparatus according to claim 15, said size and location of said aperture area of said pattern of said perforations causes an edge of said aperture in a cross-process direction to intersect lengths of one or more of said perforations, and the sum of said lengths is a constant.

19. The printing apparatus according to claim 15, said aperture area of said vacuum belt is different for different patterns of said perforations to cause said signal output by said single point light sensor to be constant.

20. The printing apparatus according to claim 15, said processor identifies when edges of said sheet are aligned with a synchronization mark based on a drop in said signal output by said single point light sensor, wherein said drop in said signal is at a constant rate of change.

* * * * *